United States Patent [19]

Seragnoli

[11] 4,380,286

[45] Apr. 19, 1983

[54] CONVEYOR SYSTEM FOR BAR-SHAPED ARTICLES, PARTICULARLY CIGARETTES

[75] Inventor: Enzo Seragnoli, Bologna, Italy

[73] Assignee: G. D. Societa' per Azioni, Bologna, Italy

[21] Appl. No.: 204,344

[22] Filed: Nov. 5, 1980

[30] Foreign Application Priority Data

Nov. 14, 1979 [IT] Italy ..... 3542 A/79

[51] Int. Cl.[3] ..... B65G 15/14

[52] U.S. Cl. ..... 198/605; 198/347; 198/624

[58] Field of Search ..... 198/347, 620, 624, 626–628, 198/604–605

[56] References Cited

U.S. PATENT DOCUMENTS 3,305,128 2/1967 Dearsley ..... 198/347 X
3,885,683 3/1975 Bormfleth et al. ..... 198/347 X
3,923,146 12/1975 Van Hall ..... 198/347

FOREIGN PATENT DOCUMENTS 2747248 5/1979 Fed. Rep. of Germany ..... 198/347
695143 9/1965 Italy ..... 198/620

*Primary Examiner*—James L. Jones, Jr.
*Assistant Examiner*—Douglas D. Watts
*Attorney, Agent, or Firm*—Merriam, Marshall & Bicknell

[57] ABSTRACT

A conveyor system for bar-shaped articles, particularly cigarettes, in which said articles are conveyed in bulk from a channel disposed at a lower level to a channel disposed at an upper level by way of a channel comprising a first substantially U-shaped portion with its concavity facing upwards, and a second ascending portion, and in which an outer wall of said first portion and a wall of said second portion are defined by a single conveyor belt, while an inner wall of said first portion is defined by a rotatable drum.

12 Claims, 5 Drawing Figures

CONVEYOR SYSTEM FOR BAR-SHAPED ARTICLES, PARTICULARLY CIGARETTES

BACKGROUND OF THE INVENTION

This invention relates to a conveyor system for bar-shaped articles, in particular cigarettes.

In the description given hereinafter, reference will be made only to bulk conveying systems for cigarettes, but this in no way detracts from its general applicability.

In known bulk conveying systems for cigarettes, one of the problems which most often arises is that of raising cigarettes along an ascending conveying channel in order to transfer them from a lower level to an upper level.

In known conveyor systems, this problem is normally solved by connecting the lower end of said ascending channel to a feed channel by way of a curve, and using along the ascending channel and said curve a plurality of conveyor belts comprising projections arranged to facilitate raising of the cigarettes.

The said known method has drawbacks both in that said projections can easily ruin the cigarettes disposed in contact with them, and in that the cigarettes tend to roll on each other and lose tobacco at the junction points of the various conveyor belts, in particular at the junction points disposed on the outside of the connection curve where the pressure exerted by the cigarettes on the belts is normally greater.

SUMMARY OF THE INVENTION

The object of the present invention is to provide a conveyor system free from the aforesaid drawbacks.

Said object is attained according to the present invention by a conveyor system for bar-shaped articles, particularly cigarettes, comprising at least one inlet, an exit, a channel connecting said inlet to said exit, and feed means disposed along said channel to move said articles along it from said inlet to said exit, said channel comprising a substantially vertical portion connected upperly to said exit, characterised in that said channel also comprises a substantially U-shaped curved portion with its concavity facing upwards, of which a first end is connected to said inlet and the second end is connected to the lower end of said vertical portion; and said feed means comprise a first conveyor belt defining an outer curved wall of said curved portion and a first wall of said vertical portion, a second conveyor belt mobile at the same speed as said first conveyor belt and defining, at least partly, a second wall of said vertical portion facing said first wall, and a rotatable drum constituting a support for said first conveyor belt along said curved portion and rotatable by said first conveyor belt; said drum defining an inner curved wall of said curved portion which is facing and parallel to said outer curved wall, and is connected to said second wall.

According to a particular characteristic of the aforesaid conveyor system, said first end of said curved portion is preferably disposed substantially on a horizontal diameter of said drum.

BRIEF DESCRIPTION OF THE DRAWINGS

Further characteristics and advantages of the present invention will be apparent from the description given hereinafter with reference to the accompanying drawings, which illustrate non-limiting examples thereof and in which.

DETAILED DESCRIPTION OF THE INVENTION

Figure 1:
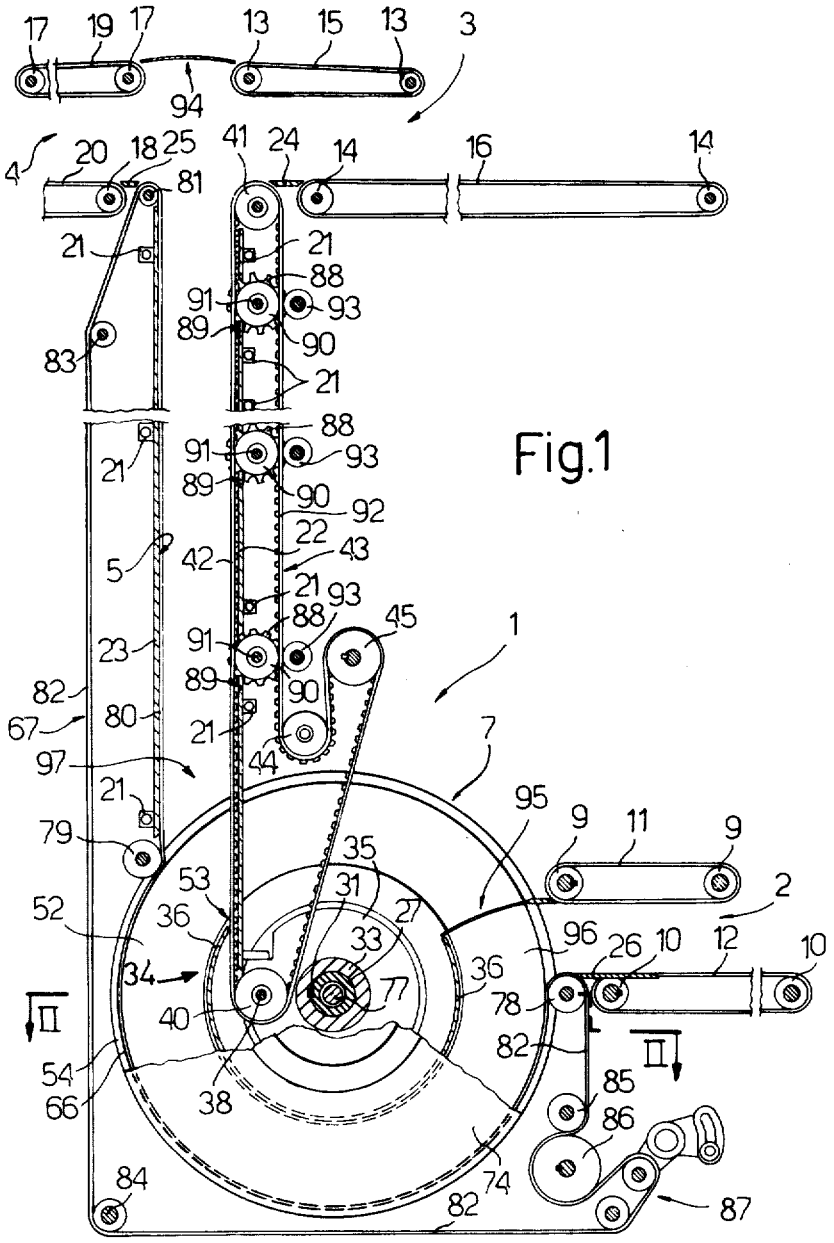
FIG. 1 is a side elevation, with parts in section and parts removed for clarity, of a first embodiment of a portion of a bulk conveyor system for cigarettes according to the prevent invention.

FIG. 1 shows a bulk conveyor system for cigarettes indicated overall by 1 and disposed between two cigarette manufacturing machines (not shown) operating in parallel at one end and a packaging machine (not shown) at the other.

The conveyor system 1 comprises a first and second inlet channel 2 and 3, disposed at different levels one above the other and each connected to a respective manufacturing machine (not shown), and an exit channel 4 connected to said packaging machine (not shown) and aligned with the inlet channel 3.

The connection between the inlet channel 2 and exit channel 4 is made by a substantially vertical channel 5 along which cigarettes 6 (FIG. 2) from the inlet channel 2 are fed by means of an elevator device indicated overall by 7.

The conveyor system 1 comprises a substantially vertical wall 8 (FIG. 2) rotatably supporting horizontal rollers 9 and 10 which support two conveyor belts 11 and 12 defining the inlet channel 2, horizontal rollers 13 and 14 which support two conveyor belts 15 and 16 defining the inlet channel 3, and horizontal rollers 17 and 18 which support two conveyor belts 19 and 20 defining the exit channel 4.

Two vertical walls 22 and 23 which define the vertical channel 5, two horizontal walls 24 and 25 which connect the vertical channel 5 to the channels 3 and 4 respectively, and a horizontal wall 26 which connects the inlet channel 2 to the elevator device 7 are all rigidly connected to the wall 8 by means of brackets 21.

Figure 2:
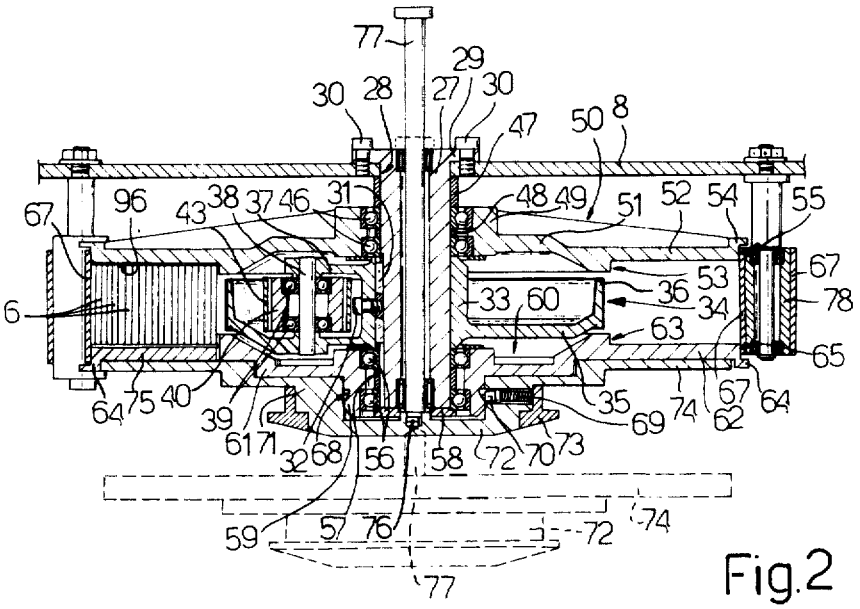
FIG. 2 is a section on the line II—II of FIG. 1.

As shown in particular in FIG. 2, the elevator device 7 comprises a tubular sleeve 27 mounted through a hole 28 in the wall 8 and comprising an annular flange 29 disposed in contact with the wall 8 and fixed thereto by screws 30. The tubular hub 33 of a fixed drum 34 is keyed on to an intermediate portion of the sleeve 27 by means of a key 31 and a threaded radial pin 32. This drum comprises an annular flange 35 extending radially outwards from the hub 33, and provided along part of its outer periphery with a substantially cylindrical wall 36 facing the hub 33 and extending along the lower part of the drum 34 over an angle greater than 180° between the lower end of the wall 22 and a point facing the exit end of the inlet channel 2.

On the side opposite that facing the channel 2, the drum 34 comprises an appendix 37 extending radially outwards from the hub 33 and supporting, together with the flange 35, a shaft 38 parallel to the sleeve 27.

A toothed pulley 40 is mounted to idle on the shaft 38 by way of bearings 39, and is disposed (FIG. 1) at the lower end of the vertical wall 22 so that, together with a second toothed pulley 41 disposed at the upper end of the vertical wall 22, it determines a straight portion 42 of a conveyor belt 43.

Said portion 42 extends in contact with that surface of the wall 22 facing the wall 23, whereas the remaining part of the belt 43 extends outside the vertical channel 5, passing around a toothed deviation pulley 44 and a drive pulley 45, both supported by the wall 8 above the drum 34.

As shown in FIG. 2, two bearings 46 are mounted on a portion of the tubular sleeve 27 adjacent to the wall 8, their inner races being locked against one end of the hub 33 by means of two tubular spacers 47 and 48, the first disposed between the wall 8 and one of the bearings 46, and the other between the two bearings 46.

The outer races of the two bearings 46 are locked inside a tubular hub 49, to the outer periphery of which there is rigidly connected a plate 50 coaxial to the sleeve 27 and comprising a cup member 51 rigid with the hub 49, an annular flat plate 52 rigid with the outer periphery of the cup member 51 and connected to this latter by an annular shoulder 53 substantially aligned with the wall 36, and an outer rim 54 extending along the outer periphery of the annular plate 52 and defining a cylindrical seat 55.

Two bearings 56 are mounted on a portion of the tubular sleeve 27 which projects outside the drum 34 at that side thereof opposite the side facing the wall 8, they being separated by a spacer 57 and axially fixed against one end of the hub 33 by an annular locking plate 58.

The outer races of the two bearings 56 are locked inside a tubular hub 59, to the outer periphery of which there is rigidly connected a plate 60 configured substantially as the specular image of the plate 50 and comprising a cup member 61 rigid with the hub 59, a plurality of spokes 62 extending radially outwards from the outer periphery of the cup member 61 and connected to this latter by an annular shoulder 63 aligned with the annular shoulder 53, and an outer rim 64. This latter is connected to the outer end of the spokes 62, and comprises externally a cylindrical seat 65 coaxial to the sleeve 27 and aligned with the seat 55 in order to define, together with this latter, a cylindrical support for a cylindrically shaped portion 66 of a conveyor belt 67. Part of the hub 59 projects outside the plate 60, and comprises an external annular groove 68, in which a radial fixing dowel 70 is engaged under the thrust of a spring 69, this dowel being mounted through a side wall 71 of a cup member 72 mounted over the end of the hub 59 and constructed of a transparent material externally strengthened by means of an annular metal ring 73. An annular plate 74 also constructed of transparent material is fixed to the periphery of the cup member 72 so that it forms an integral part thereof, and extends in contact with the plate 60 and the spokes 62, and has connected to it, on the side facing the plate 50, transparent sectors 75 each of which engages perfectly in the space existing between a respective pair of adjacent spokes 62, and extends between the inner periphery of the rim 64 and the outer periphery of the cup member 61.

The base wall of the cup member 72 comprises a central bore 76 coaxial to the tubular sleeve 27, inside which there is fixed one end of a rod 77 slidably mounted through a tubular sleeve 27 and projecting from that end of this latter which carries the flange 29. The rod 77 terminates outside the sleeve 27 in a head, by acting on which it is possible to axially move the rod 77 along the sleeve 27 to disengage the cup member 72 from the hub 59 against the action of the spring 69, and move the assembly constituted by the cup member 72, the plate 74 and the sectors 75 into the position shown by the dashed line in FIG. 2 so as to make the inner toroidal compartment of the rotatable drum constituted by the plates 50 and 60 accessible from the outside.

The curved portion 66 of the belt 67 is kept in contact with the seats 55 and 65 by two pulleys 78 and 79, the first disposed at the exit of the inlet channel 2 and the second disposed immediately below the lower end of the vertical wall 23. The pulley 79 is disposed at the lower and of a straight portion 80 of the belt 67, which extends in contact with the inner surface of the vertical wall 23 and is deviated to the outside of this latter, at the upper end thereof, by a pulley 81 disposed at the inlet of the exit channel 4. The upper end of the straight portion 80 of the belt 67 is connected to the inlet end of the curved portion 66 by a portion 82 which extends outside the vertical channel 5 and the elevator device 7 in contact with deviating pulleys 83, 84 and 85, a drive pulley 86 and a tensioning device 87.

In order to favour the upper movement of the cigarettes along the vertical channel 5, the conveyor system 1 can, if considered opportune, be provided with a plurality of tooth wheels 88 (FIG. 1), the toothing of which penetrates into the channel 5 through respective slots 89 provided in the vertical wall 22. Each toothed wheel 88 is rigid with a respective roller 90 rotatably mounted on a respective pin 91 and disposed between the straight portion 42 of the conveyor belt 43 and a second straight portion 92 of this latter extending parallel to the portion 42 externally to the channel 5 between the toothed pulleys 41 and 40.

Contact between the conveyor belt 43 and each roller 90 is provided by a respective pressure roller 93.

The conveyor 1 is provided with two devices, indicated respectively by 94 and 95, for controlling the quantity of cigarettes fed by the channels 3 and 2 to the channel 4.

The control devices 94 and 95 are disposed at the junction of the channels 3, 4 and 5 immediately above the upper end of the channel 5 and at the junction between the channel 2 and the elevator device 7 respectively, and each comprises diaphragm means or any other means arranged to determine the pressure of the cigarettes at the relative junction and to control the speed of the belts 19 and 20 and of the elevator device 7, in order to maintain said pressure within a predetermined optimum pressure range.

When in operation, the cigarettes from the inlet channel 2 advance along the elevator device 7 passing through a substantially U-shaped curved channel 96 defined internally by the two annular shoulders 53 and 63 and externally by the inner surface of the curved portion 66 of the conveyor belt 67.

The movement of the cigarettes along the channel 96 is determined by the substantially constant-speed movement of the conveyor belt 67, which by rotating the plates 50 and 60 causes the cigarettes disposed in contact with the portion 66 to advance at a first constant speed, and in addition causes the cigarettes disposed in contact with the shoulders 53 and 63 to advance at a second constant speed which is less than said first speed, and also causes all the others to advance by friction.

The movement of the cigarettes along the channel 96 is also favoured by the U-shape of the channel 96, in that because of the principle of communicating compartments, the pressure acting on the cigarettes disposed at the inlet of the channel 96, which is suitably located at a horizontal diameter of the drum 34, is transmitted to the cigarettes disposed at the exit end of the channel 96, in this way reducing the friction necessary for moving the cigarettes disposed in the channel 96 at a certain distance from the belt 67 and from the shoulders 53 and 63.

The cigerattes leaving the channel 96 penetrate into a substantially vertical channel 97 defined, within the channel 5, between the straight portions 42 and 80 of the conveyor belts 43 and 67. As shown in FIG. 1, the width of the vertical channel 97 is less than the width of the curved channel 96, and is chosen according to the formula:

$$S=(R^2-r^2)2R$$

where R and r are the outer and inner radii respectively of the channel 96, and S is the width of the channel 97. If the width of the channel 97 is chosen according to this formula, the speed of movement of the cigarettes along the channel 97 is equal to the speed of movement of the straight portion 80 of the belt 67, in respect of the equation of constancy of the throughput of cigarettes in the channels 96 and 97.

Consequently, by driving the belt 43 at the same speed as the belt 67, it is possible to raise the cigarettes along the channel 97 while substantially reducing to zero the friction between one cigarette and another along the channel 97 and reducing to an acceptable minimum the friction which occurs between the cigarettes in the inclined section connecting the channel 96 to the channel 97. With regard to the aforegoing, it should be noted that as shown in FIG. 1 the axis of the channel 97 intersects the circular axis of the channel 96 instead of being tangential to it.

In other words, the channel 96 extends above its horizontal diameter, and the junction between the channels 96 and 97 is disposed at a point of the channel 96 lying between said horizontal diameter and a vertical diameter. In consequence of this arrangement, the individual radial layers which make up the bulk of cigarettes between the curved channel 96 enter the vertical channel 97 without becoming disturbed, and travel through it by moving parallel to the position assumed by them at the final or exit end of the curved channel 96. At the upper end of the channel 97, the cigarettes from the elevator device 7 join those fed through the channel 3 from the second manufacturing machine, in order to feed the packaging machine disposed at the exit end of the channel 4.

Figure 4:
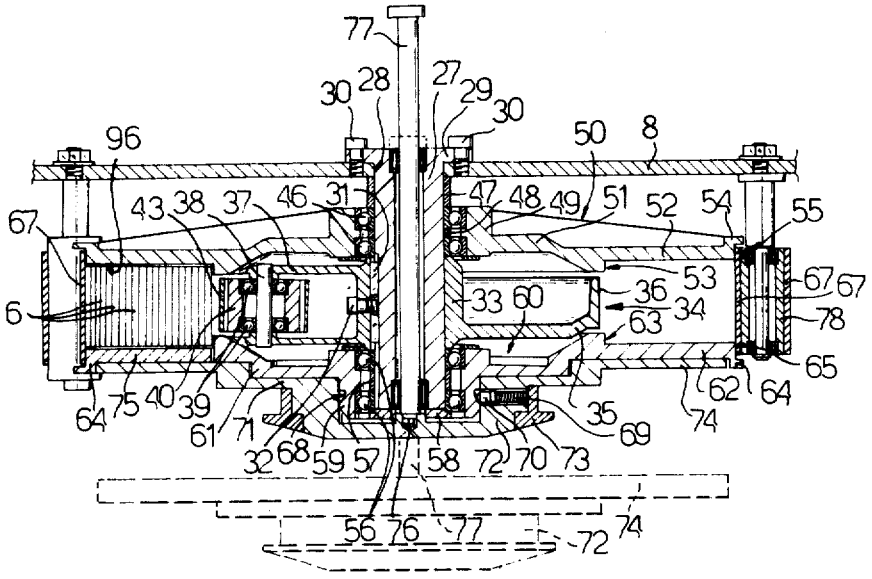
FIG. 4 is a section on the line IV—IV of FIG. 3.
Figures 3, 5:
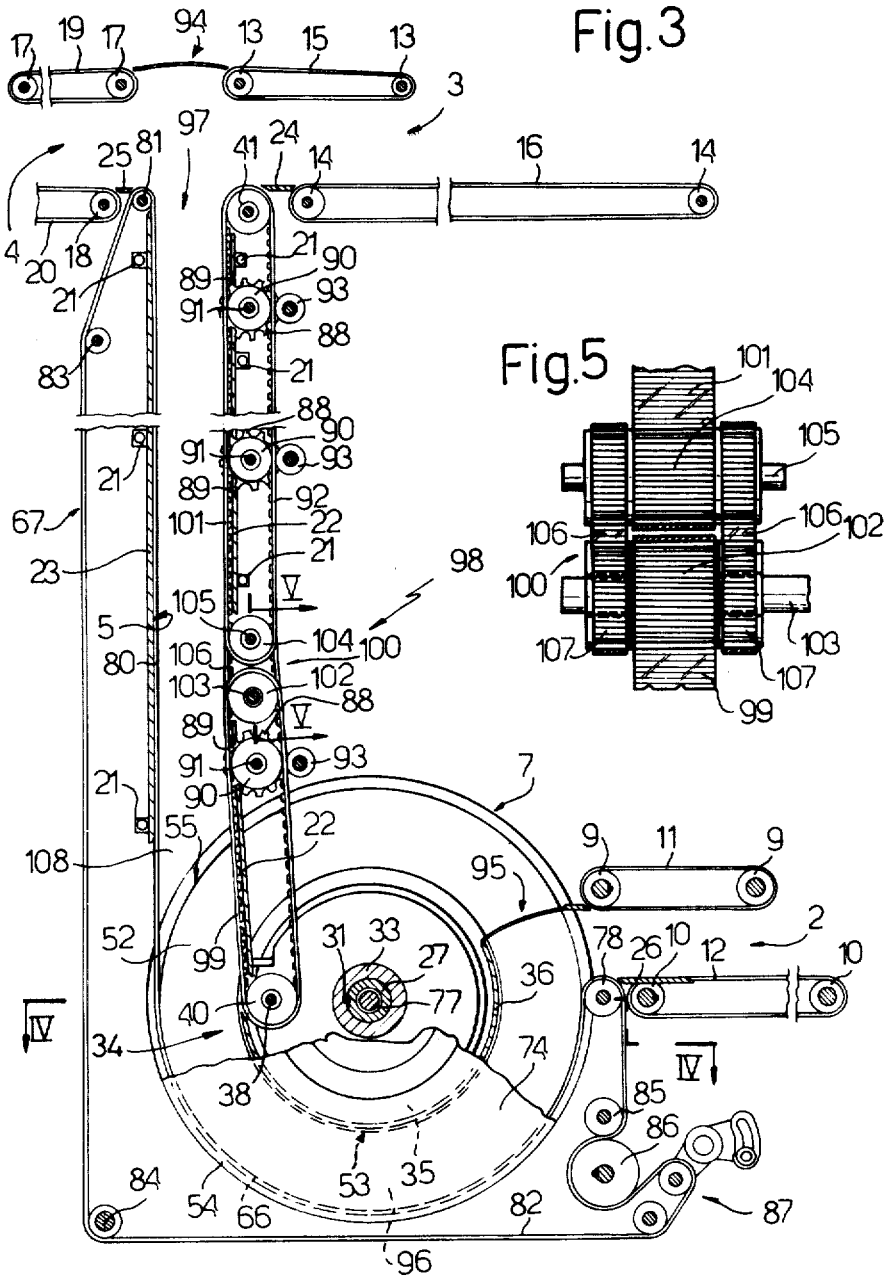
FIG. 3 is a side elevation, with parts in section and parts removed for clarity, of a second embodiment of a portion of a bulk conveyor system for cigarettes according to the present invention.
FIG. 5 is an enlarged side view of a detail of FIG. 3.

FIGS. 3, 4 and 5 relate to a conveyor system 98 having a structure very similar to that of the conveyor system 1, and in which the common parts are indicated by the same reference number which identifies them in FIGS. 1 and 2.

The system 98 differs from the system 1 in that its cylindrical wall 36 extends through an angle of about 180°, which is less than that of the wall 36 of the system 1, and its radial appendix 37 extends more towards the outside so as to support the toothed pulley 40 in a position substantially tangential to the cylindrical surface defined by the annular shoulders 53 and 63.

In the conveyor system 98, the conveyor belt 43 of the system 1 is replaced by three conveyor belts 99, 100 and 101, of which the former passes both over the pulley 40 and over a second pulley 102 keyed on to a drive shaft 103 supported by the wall 8, and the latter passes both over the pulley 41 and over a pulley 104 disposed adjacent to the pulley 102 and keyed on to a drive shaft 105 supported by the wall 8. The conveyor belt 100 comprises two belts 106, which are disposed parallel to and on opposite sides of the belts 99 and 101 at a distance apart which is less than the length of the cigarettes to be conveyed, and pass over the pulley 104 and under respective pulleys 107 mounted idly on the shaft 103.

Whereas the conveyor belts 100 and 101 are disposed parallel to the straight portion 80 of the belt 67 at a distance therefrom given by said formula:

$$S=(R^2-r^2)2R$$

and move at a speed equal to that of the belt 67, the conveyor belt 99 is disposed inclined to the straight portion 80 of the belt 67 so as to define, with this latter, a first portion 108 of the channel 97 which tapers upwards, and moves at a speed between that of the belt 67 and that of the shoulders 53 and 63.

Finally, in the conveyor system 98, the pulley 79 is dispensed with, and the straight portion 80 of the belt 67 is disposed tangential to the seats 55 and 65.

In the conveyor system 98, the passage cross-section for the cigarettes is reduced progressively along the tapered portion 108 to correspond to the increase in the average cigarette speed, until the speed of the belt 67 is attained.

In modifications, not shown, the tapered portion 108 can obviously be obtained by also inclining a first part of the portion 80, or inclining only this latter and leaving the belt 99 in a position aligned with the belts 100 and 101.

Within the principle of the invention, numerous modifications can be made to the described conveyors 1 and 93 without leaving the scope of the inventive idea.

What I claim is:

1. A conveyor system for bar-shaped articles, particularly cigarettes, comprising at least one inlet, an exit, a channel connecting said inlet to said exit, and ffed means disposed along said channel to move said articles along it from said inlet to said exit, said channel comprising a substantially vertical portion connected upperly to said exit, characterized in that said channel also comprises a substantially U-shaped curved portion with its concavity facing upwards, of which a first end communicates with said inlet and the second end communicates with the lower end of said vertical portion; and said feed means comprise a first conveyor belt defining an outer curved wall of said curved portion and a first wall of said vertical portion, a second conveyor belt mobile at the same speed as said first conveyor belt and defining, at least partly, a second wall of said vertical portion facing said first wall, and a rotatable drum constituting a support for said first conveyor belt along said curved portion and rotatable by said first conveyor belt; said drum defining an inner curved wall of said curved portion which faces and is parallel to said outer curved wall, and is in bar-shaped article delivery communication with said second wall.

2. A conveyor system as claimed in claim 1, characterised in that said first end of said curved portion is disposed substantially on a horizontal diameter of said drum.

3. A conveyor system as claimed in claim 2, characterised in that said curved portion extends, starting from said first end, through a circular arc which subtends an angle at its centre of at least 180°.

4. A conveyor system as claimed in claim 1, characterised in that said rotatable drum comprises two mutually coaxial circular plates rotatably mounted about a horizontal axis and each having a peripheral cylindrical surface which together with the peripheral cylindrical surface of the other plate defines a cylindrical support seat for said first belt; each of said plates comprising, on that surface facing the other plate, an annular shoulder which is coaxial to said axis and which, together with the other said annular shoulder, defines said inner curved wall.

5. A conveyor system as claimed in claim 1, characterised in that lifting means are provided along said vertical portion to facilitate the upward movement of said articles.

6. A conveyor system as claimed in claim 5, characterised in that said lifting means comprise a plurality of toothed wheels disposed at different levels along said vertical portion and rotatable about horizontal axes under the thrust of drive means, each of said toothed wheels being disposed on the outside of said vertical portion so that part of its toothing penetrates to the inside thereof through a respective slot.

7. A conveyor system for bar-shaped articles, particularly cigarettes, comprising at least one inlet, an exit, a channel connecting said inlet to said exit, and feed means disposed along said channel to move said articles along it from said inlet to said exit, said channel comprising a substantially vertical portion connected upperly to said exit, characterized in that said channel also comprises a substantially U-shaped curved portion with its concavity facing upwards, of which a first end communicates with said inlet and the second end communicates with the lower end of said vertical portion; and said feed means comprise a first conveyor belt defining an outer curved wall of said curved portion and a first wall of said vertical portion, a second conveyor belt mobile at the same speed as said first conveyor belt and defining, at least partly, a second wall of said vertical portion facing said first wall, and a rotatable drum constituting a support for said first conveyor belt along said curved portion and rotatable by said first conveyor belt; said drum defining an inner curved wall of said curved portion which faces and is parallel to said outer curved wall, and is in bar-shaped article delivery communication with said second wall;

said rotatable drum comprising two mutually coaxial circular plates rotatably mounted about a horizontal axis and each having a peripheral cylindrical surface such that together the peripheral cylindrical surfaces define a cylindrical support seat for said first belt; and with each of said plates having on the surface facing the other plate, an annular shoulder which is coaxial to said axis and which annular shoulders together define said inner curved wall; and a further drum, coaxial to said rotatable drum, mounted in an angularly fixed position between the plates of the rotatable drum, with said fixed drum supporting a pulley for the second conveyor belt.

8. A conveyor system according to claim 7 in which the pulley is located at the lower end of said second wall.

9. A conveyor system according to claim 8 in which the second wall intersects said inner curved wall, said pulley acting as a deviation member for said second belt, with this belt defining the entire said second wall.

10. A conveyor system according to claim 8 in which the second wall is substantially tangential to said inner curved wall, said pulley acting as a deviation member for a third belt defining a lower portion of said second wall.

11. A conveyor system according to claim 10 in which that part of said substantially vertical channel portion extending along said third belt tapers upwards, said third belt being mobile at a speed between that of said first belt and that of said inner curved wall.

12. A conveyor system according to claim 10 comprising a further pair of belt defining an intermediate portion of said second wall, said further belts being disposed side-by-side and at a distance from each other which is less than the length of said articles.

* * * * *